US007247376B1

(12) United States Patent
Chen et al.

(10) Patent No.: US 7,247,376 B1
(45) Date of Patent: Jul. 24, 2007

(54) POWDER CONTAINING FE-NI NANO-PARTICLES AND ITS MANUFACTURING METHOD

(76) Inventors: Wen-Jauh Chen, No. 9, Lane 24, Shihlin Rd., Douliou City, Yunlin County 640 (TW); Wei-Long Liu, No. 15, Lane 308, Siping Rd., Douliou City, Yunlin County 640 (TW); Ting-Kan Tsai, No. 8, Alley 1, Lane 49, Si-an St., Huwei Township, Yunlin County 632 (TW); Shu-Huei Hsieh, No. 22-21, Dingwei, Tuku Township, Yunlin County 633 (TW); Jao-Jia Horng, No. 123, Sec. 3, Dasyue Rd., Douliou City, Yunlin County 640 (TW)

( * ) Notice: Subject to any disclaimer, the term of this patent is extended or adjusted under 35 U.S.C. 154(b) by 307 days.

(21) Appl. No.: 10/868,770

(22) Filed: Jun. 17, 2004

(51) Int. Cl.
*B32B 5/16* (2006.01)

(52) U.S. Cl. ..... 428/403; 428/701

(58) Field of Classification Search ..... 428/570, 428/403, 404, 700, 701
See application file for complete search history.

(56) References Cited

U.S. PATENT DOCUMENTS 4,532,190 A * 7/1985 Kanbe et al. ..... 428/627
4,624,798 A * 11/1986 Gindrup et al. ..... 252/62.54
4,944,985 A * 7/1990 Alexander et al. ..... 428/570
5,134,039 A * 7/1992 Alexander et al. ..... 428/614
5,512,094 A * 4/1996 Linton ..... 106/409
5,616,423 A * 4/1997 Sanjyou et al. ..... 428/632
5,963,771 A * 10/1999 Chan et al. ..... 419/2
6,277,489 B1 * 8/2001 Abbott et al. ..... 428/403
6,746,508 B1 * 6/2004 Deevi et al. ..... 75/255
6,878,445 B2 * 4/2005 Hattori et al. ..... 428/402
2005/0227074 A1 * 10/2005 Oyamada et al. ..... 428/403

OTHER PUBLICATIONS

Shin and Keane, "Detoxifying chlorine rich gas streams using solid supported nickel catalysts", Journal of Hazardous Materials B 66 (1999) 265-278.*

* cited by examiner

*Primary Examiner*—H. Thi Le
(74) *Attorney, Agent, or Firm*—Lowe Hauptman & Berner, LLP

(57) ABSTRACT

A powder containing Fe—Ni nano-particles and a method for manufacturing the powder, wherein the powder containing Fe—Ni nano-particles includes a carrier and Fe—Ni nano-particles. The carrier is a ceramic particle with size of about micro-meter (μm). Fe and Ni atoms of the Fe—Ni nano-particles exist simultaneously on the surface of the carrier by electroless plating technology. The atomic ratio of the Fe and Ni atoms can be controlled by changing the relative concentration of the plating solution and the plating condition. The method for manufacturing the powder containing Fe—Ni nano-particles includes the following steps: preparation process, sensitization process, activation process, electroless plating process, and after-deposition process. The manufactured powder has small volume and large surface area. The contact chance between Fe/Ni bimetal and chlorinated organic substance is largely increased. It can be used to treat various environmental pollutants or for some catalytic reactions.

2 Claims, 3 Drawing Sheets

POWDER CONTAINING FE-NI NANO-PARTICLES AND ITS MANUFACTURING METHOD

BACKGROUND OF THE INVENTION

1. Field of the Invention

The present invention relates to a powder containing Fe—Ni nano-particles and its manufacturing method, and particularly to a powder having a film of Fe—Ni nano-particles deposited on the surface. The powder containing Fe—Ni nano-particles has very small volume and very large surface area. The contact chance between Fe/Ni bimetal and chlorinated organic substance is largely increased. It can be used to treat various environmental pollutants or for some catalytic reactions, and particularly to treat the organic pollutants containing chlorine in environment.

2. Description of the Prior Art

The chlorinated organic substance generally has strong toxicity, which are rather dangerous to the human body and the environment of living things. For example, tetrachloroethene (PCE) and carbon tetrachloride (CT) have been proved to be able to cause cancer on human body, and the other various chlorinated organic substance are also possible for human to cause cancer. The chlorinated organic substance such as chloroform (CF), trichloroethene (TCE), dichloromethane (DCM), PCE and CT etc. are widely used in industry. They are chiefly used for degreasing, dyeing, cleaning and printed circuit manufacturing processes. These kinds of compounds are rather stable and not easy to be resolved. Their resolvability in water is low and easy to accumulate in soil and underground water so that they after become the general pollutants in soil and underground water. Therefore, besides to make law to prevent the chlorinated organic substance from entering the environment, the place that has been polluted by the chlorinated organic substance must be treated and remedied as quickly as possible.

The chlorine atom has high electronegativity and can adsorb electrons from neighborhood, so the most carbons in the chlorinated organic substance exist at relatively high oxidation state and the chlorine in the chlorinated organic substance can be resolved and removed by the reduction method. Because the iron metal has rather high reducing power, i.e. able to provide electrons, it can be used to resolve various chlorinated organic substance such as chlorinated methane, chlorinated ethane, trichloroethene, tetrachloroethene, trichloroethane, and trichloromethane etc.

Although the iron metal can effectively resolve the chlorinated organic substance, it would occur that the pH value does increase in the dechlorine process and the surface of the iron particle does form some iron oxide in the environment containing water and is covered up, so the activity of the iron is reduced and the ability for resolving the chlorinated organic substance is lowered.

In order to improve the drawback of the iron metal as stated above, the second kind of metal such as Pd, Ni, Ag, Cu, and Au is added in the iron to form bimetal, keep the dechlorine activity for iron surface and promote the reaction of dechlorine. Among these metals, Ni has catalysis and anti-corrosion in water, so it is relatively often used to form Fe/Ni bimetal for dechlorine.

The ability of bimetal, for removing the chlorinated organic substance, is higher than iron metal. For resolving the chlorinated organic substance, the dechlorine substance needs possess both the reducing power and large surface area. The more the surface area, the higher the dechlorine power. Therefore, it is necessary that the bimetal is made into micro-particles with large surface area. The micro-particle of metal as a dechlorine agent cannot only promote the surface contact and reaction but also increase the penetrative power in the contaminated soil to promote the treatment effect.

The volume of the metal particle must be decreased to increase its surface area. If the volume of the metal particle is too small, it will quickly penetrate through the soil and easily flows away. Therefore, the time of contact and reaction between metal and chlorinated organic substance becomes too short and the effect of removing chlorinated organic substance by metal is lowered. The problem of penetration and loss of the metal particle must also be considered when the volume of the metal particle is reduced to increase the surface area.

In addition, it is rather difficult in technique how to make micro-particles of Fe—Ni bimetal, especially particles with nanometer size. In the prior technique, the nano-particles of iron metal are first made, and subsequently the iron nano-particles are put into the solution containing $Ni^{++}$ to make the Fe atoms on the surface of the particles be replaced by the Ni atoms. The reducing reaction is shown in the following:

$$Ni^{++}+Fe^{o}\rightarrow Fe^{++}+Ni^{o}$$

But the Fe—Ni particles made by this way are strictly not the real Fe/Ni bimetal, they are only the iron particles of which surface are covered with a film of Ni. Only the film of Ni can touch the chlorinated organic substance to proceed the reducing and resolving reaction, and the Fe atoms inside have no chance to touch the chlorinated organic substance at all.

In order to get the real Fe—Ni nano-particles, of which Fe and Ni atoms can simultaneously exist on the surface of the particles and have the same chance to touch with chlorinated organic substance and proceed reducing and catalyzing reaction, and to prevent the particles in the contaminated soil from flowing away due to their small volume. Therefore, the present invention provides a powder and its manufacturing method, which can solve the all problems as stated above.

SUMMARY OF THE INVENTION

The primary object of the present invention is to provide a powder containing Fe—Ni nano-particles. The powder has a carrier and Fe—Ni nano-particles. The Fe—Ni nano-particles are deposited on the surface of the carrier by an electroless plating technique. The carrier has about μm of size and has very large surface area. The contact area between Fe/Ni bimetal and chlorinated organic substance is largely increased and the effect of processing chlorinated pollutants is consequently promoted.

Another object of the present invention is to provide a method for manufacturing a powder containing Fe—Ni nano-particles. The method chiefly uses the electroless plating technique to connect Fe—Ni nano-particles on the surface of the μm-sized carrier. The atomic ratio of the Fe and Ni atoms in the Fe—Ni nano-particles can be controlled by changing the relative concentration of the $Fe^{++}$ and $Ni^{++}$ ions in the plating solution and the plating condition. It suits for various chlorinated pollutant treatments.

Another object of the present invention is to provide a powder containing Fe—Ni nano-particles including the carrier, which is ceramic particle and is μm-sized. It suits for penetrating the soil containing pollutants and does not quickly flow away.

In order to achieve the objects as stated above, the present invention selects some ceramic particles with about micrometer size as the carrier. These ceramic particles have the following characteristics: stable in chemistry, no contamination to environment and cheap. These ceramic particles include $Al_2O_3$, $SiO_2$, $TiO_2$, CaO, SiC and WC etc. The carrier first is cleaned in the aqueous solution containing HCl, $H_2SO_4$ or HF in order to remove the dirt on the surface of the carrier and activate the surface atoms of the carrier. The carrier then is sensitized and activated in the solution of $SnCl_2$ and the solution of $PdCl_2$ to make the surface of the carrier be plated a film of catalytic substance. Subsequently the surface of the carrier is deposited a film of Fe—Ni nano-particles in the solution containing Fe and Ni ions. At last, the powder containing Fe—Ni nano-particles is dried in the drying furnace with protective atmosphere.

The powder containing Fe—Ni nano-particles obtained by the above-stated steps, comprising the carrier and Fe—Ni nano-particles, wherein the size of the carrier is about micrometer (μm) and Fe and Ni atoms of the Fe—Ni nano-particles are simultaneously deposited on the surface of the carrier. The size of the Fe—Ni nano-particles is from several nanometers (nm) to several hundred of nanometers. The atomic ratio of the Fe and Ni atoms can be controlled by changing the relative concentration of the plating solution and the plating condition, wherein the Fe—Ni nano-particles contain 0(a trace)~25 wt % Fe and 75~100 wt % Ni.

In order to let the objects, technique and advantages of the present invention be deeply understood, there are some preferred embodiments with drawings described in detail below.

DETAILED DESCRIPTION OF THE PREFERRED EMBODIMENT

Figure 1:
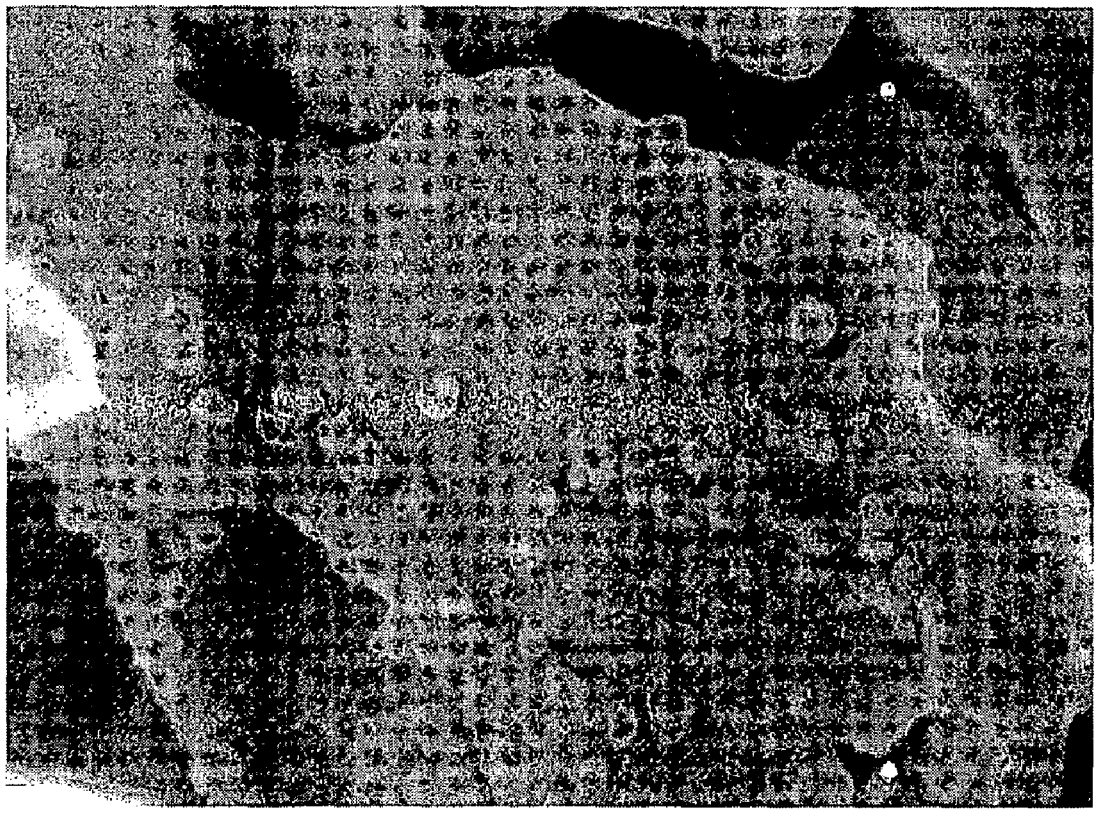
FIG. 1 is a magnifying view of the powder containing Fe—Ni nano-particles magnified 100000 times by the field emission scanning electron microscope (SEI) according to an embodiment of the present invention, wherein individual Fe—Ni nano-particles on the irregular surface of the carrier can be clearly seen and the plating time of the sample in the view is about 10 minutes.

The method for manufacturing a powder containing Fe—Ni nano-particles according to the present invention first selects a ceramic particle as a carrier. The ceramic particle can be $Al_2O_3$, $SiO_2$, $TiO_2$, CaO, SiC, WC or the like. The average size of the carrier is μ-sized. And then proceed the steps as follows.

(1) Preparation process: the carriers are put into a cleansed solution to clean the surface of the carrier and subsequently into a deionized water to remove the cleansed solution on the surface of the carrier. The cleansed solution used in preparation process is an acid aqueous, which has HCl, $H_2SO_4$, HF, etc.

(2) Sensitization process: the carriers after preparation process are put into a sensitized solution to make the surface of the carrier be deposited a film containing Sn and subsequently into the deionized water to remove the sensitized solution on the surface of the carrier. The sensitized solution is an aqueous solution containing $SnCl_2$ and HCl and a magnetic rod stirrer is used to promote the sensitization reaction.

(3) Activation process: the carriers after sensitization process are put into an activated solution to make the surface of the carrier be deposited a film containing Pd. The activated solution is an aqueous solution containing $PdCl_2$ and HCl and a magnetic rod stirrer is used to promote the activation reaction.

(4) Electroless plating process: the carriers after activation process are put into the deionized water to remove the activated solution on the surface of the carrier and subsequently into an electroless plating solution to make the surface of the carrier be deposited a film containing Fe—Ni nano-particles, wherein the electroless plating solution can have several types as follows.

(a) The electroless plating solution is an aqueous solution including $NiCl_2$, $(NH_4)_2Fe(SO_4)_2$, $NaH_2PO_2$, $NH_4OH$ and $KNaC_4H_4O_6$, the pH value of the electroless plating solution is adjusted between 8 and 11, the temperature of the electroless plating solution is about 75° C., and a stirrer is used to promote the plating effect.

(b) The electroless plating solution is an aqueous solution including $NiSO_4$, $(NH_4)_2Fe(SO_4)_2$, $NaH_2PO_2$, $NH_4OH$ and $KNaC_4H_4O_6$, the pH value of the electroless plating solution is about 9.5, the temperature of the electroless plating solution is in the range of 20~30° C., and a stirrer is used to promote the plating effect.

(c) The electroless plating solution is an aqueous solution including $NiCl_2$, $FeCl_2$, $NaH_2PO_2$, $NH_4OH$ and $KNaC_4H_4O_6$, the pH value of the electroless plating solution is between 9 and 11, the temperature of the electroless plating solution is about 75° C., and a stirrer is used to promote the plating effect.

(d) The electroless plating solution is an aqueous solution including $Ni(Ac)_2$, $FeSO_4$, $NaH_2PO_2$, $NH_4OH$, $CO(NH_2)_2$, and $KNaC_4H_4O_6$, the pH value of the electroless plating solution is between 8 and 10, the temperature of the electroless plating solution is about 9° C., and a stirrer is used to promote the plating effect.

(e) The electroless plating solution is an aqueous solution including $NiSO_4$, $FeSO_4$, $H_3BO_3$, $NaH_2PO_2$, and $Na_3C_6H_5O_7$, the pH value of the electroless plating solution is about 10, the temperature of the electroless plating solution is about 90° C., and a stirrer is used to promote the plating effect.

(5) After-deposition process: the carriers after electroless plating process are put into the deionized water to remove the electroless plating solution on the surface of the carrier and subsequently into a furnace to dry the carrier under an atmosphere of inert or reducing gases. The drying temperature of the furnace is between 100~200° C. and the drying atmosphere is $N_2$, Ar, or $H_2$ gas.

The powder containing Fe—Ni nano-particles obtained by the above-stated steps, comprising the carrier and Fe—Ni nano-particles, wherein the size of the carrier is about micrometer (μm) and Fe and Ni atoms of the Fe—Ni nano-particles are simultaneously deposited on the surface of the carrier. The size of the Fe—Ni nano-particles is from several nanometers (nm) to several hundred of nanometers. The atomic ratio of the Fe and Ni atoms can be controlled by changing the relative concentration of the plating solution and the plating condition, wherein the Fe—Ni nano-particles contain 0(a trace)~25 wt % Fe and 75~100 wt % Ni. Now there are some embodiments described in detail below.

Embodiment (1)

Figure 2:
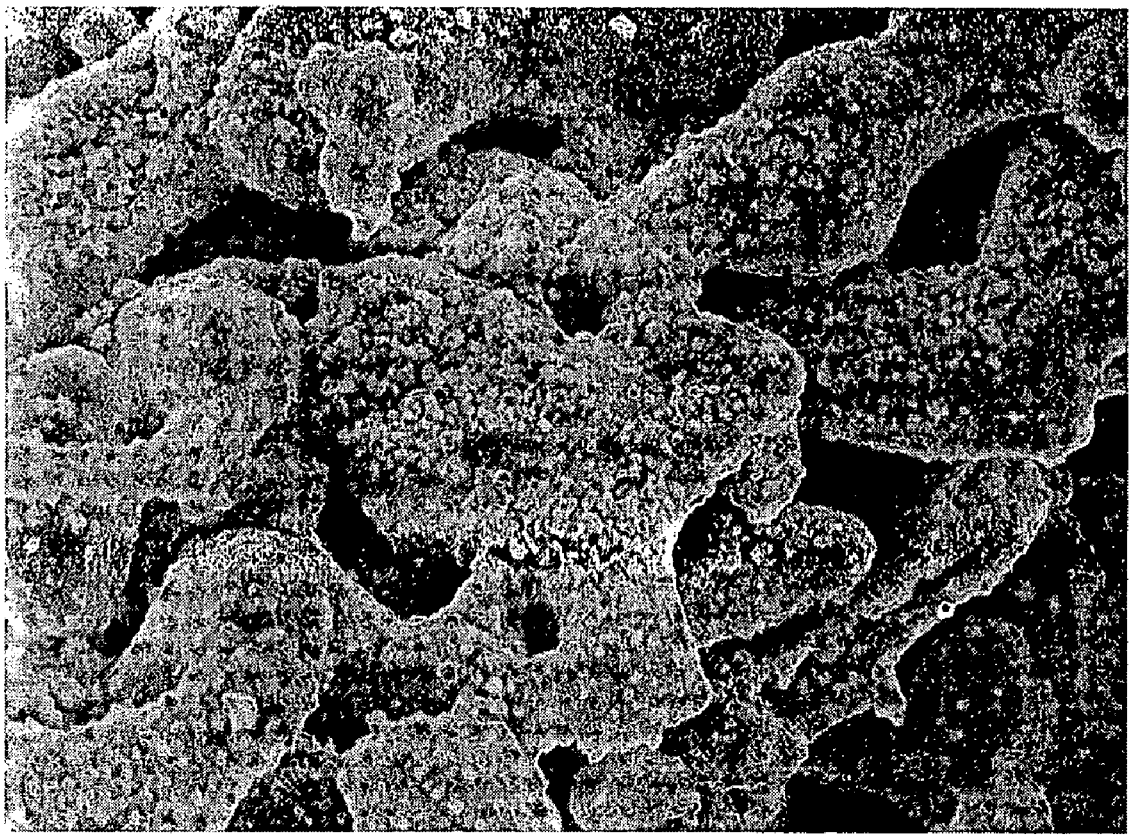
FIG. 2 is a magnifying view of the powder containing Fe—Ni nano-particles magnified 50000 times by the field emission scanning electron microscope according to the embodiment of the present invention, wherein individual Fe—Ni nano-particle on the irregular surface of the carrier can be clearly seen and the plating time of the sample in the view is about 30 minutes.
Figure 3:
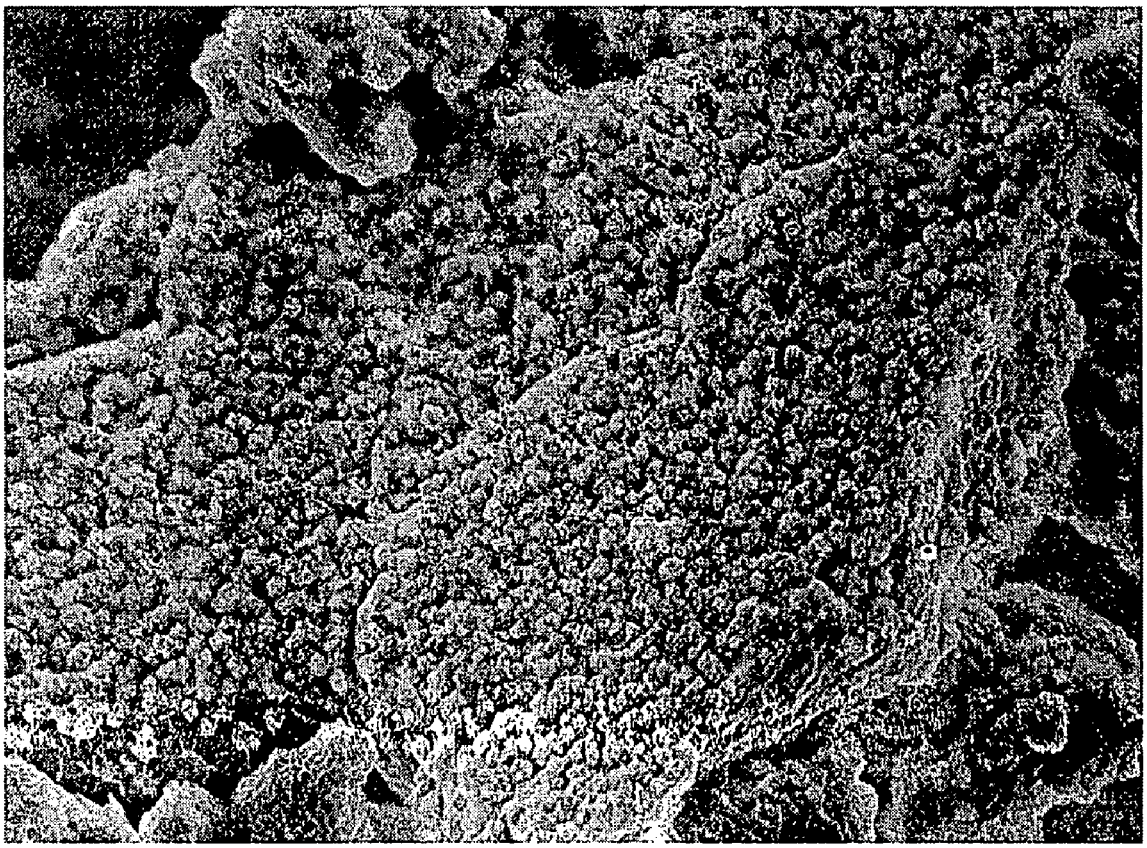
FIG. 3 is a magnifying view of the powder containing Fe—Ni nano-particles magnified 50000 times by the field emission scanning electron microscope according to the embodiment of the present invention, wherein the Fe—Ni nano-particles fully deposited over the irregular surface of the carrier can be clearly seen and the plating time of the sample in the view is about 60 minutes.

Referring to FIGS. 1, 2, and 3, the $Al_2O_3$ ceramic particles are taken as the carrier according to the embodiment (1). The $A_2O_3$ particles are very irregular in shape and have about micrometer (μm) sizes. And then proceed the steps as follows.

(1) Preparation process: at first, the $Al_2O_3$ particles are put into the acid aqueous solution (about 2 wt % $H_2SO_4$ aqueous solution) and are vibrated for 30 minutes by ultrasonic vibrator in order to disperse the $Al_2O_3$ particles, remove the dirt on the surface of the $Al_2O_3$ particles and activate the surface atoms of the $Al_2O_3$ particles. The $Al_2O_3$ particles are then filtered out and put into the deionized water to remove the acid solution on the surface of the $Al_2O_3$ particles under the help of a vibrator.

(2) Sensitization process: after preparation process, the $Al_2O_3$ particles are put into the aqueous solution containing $Sn^{++}$ ions ($SnCl_2$+HCl) and stirred about 2 minutes to make the surface of the $Al_2O_3$ particles be deposited a film containing Sn. Subsequently the $Al_2O_3$ particles are filtered out and put into the deionized water to remove the sensitized solution on the surface of the $Al_2O_3$ particles under the help of a stirrer.

(3) Activation process: after sensitization process, the $Al_2O_3$ particles are put into the aqueous solution containing $Pd^{++}$ ions ($PdCl_2$+HCl) and stirred about 30 seconds to make the surface of the $Al_2O_3$ particles be deposited a film containing Pd. The $Al_2O_3$ particles are then filtered out and put into the deionized water to remove the activation solution on the surface of the $Al_2O_3$ particles under the help of a stirrer.

(4) Electroless plating process: after activation process, the $Al_2O_3$ particles are put into the aqueous solution containing $Fe^{++}$ and $Ni^{++}$ ions (the plating bath and operation parameters show in table (1) below) and stirred about one hour to make the surface of the $Al_2O_3$ particles be deposited a film containing Fe—Ni nano-particles. Then the $Al_2O_3$ particles are filtered out and put into the deionized water to remove the electroless plating solution on the surface of the $Al_2O_3$ particles under the help of a stirrer.

TABLE 1

The electroless plating bath and the operation parameters

| Ingredient or parameter | Chemical formula | Concentration or Value |
|---|---|---|
| Nickel chloride | $NiCl_2 \cdot 6H_2O$ | 14 (g/L) |
| Ammonium ferrous sulfate | $(NH_4)_2Fe(SO_4)$ | 10 (g/L) |
| Sodium hypophosphate | $NaH_2PO_2 \cdot H_2O$ | 10 (g/L) |
| Ammonium hydroxide | $NH_4OH$ | 125 (g/L) |
| Potassium sodium tartarate | $KNaC_4H_4O_6$ | 70 (g/L) |
| pH | | 9.5 |
| Temperature | | 75° C. |

(5) After-deposition process: after electroless plating process, the $Al_2O_3$ particles are put into drying furnace to be dried for 1 hr at 100° C. in the $H_2$ gas with 100 c.c./min flow rate. At last, the $Al_2O_3$ powder containing Fe—Ni nano-particles are taken out and packed for use in the future.

FIGS. 1, 2, and 3 are the magnifying images of the $Al_2O_3$ powder containing Fe—Ni nano-particles of the embodiment 1 of the present invention, which are magnified by the field emission scanning electron microscope (SEI). The plating time of the samples in FIGS. 1 and 2 are relatively short and FIG. 3 is relatively long. As shown in FIG. 1, there are some Fe—Ni nano-particles on the irregular surface of the $Al_2O_3$ particle. When the plating time is increased, the Fe—Ni nano-particles on the surface of the $Al_2O_3$ particle become more and more as shown in FIG. 2. At last, if the plating time is long enough, there are Fe—Ni nano-particles fully deposited over the surface of the $Al_2O_3$ particle as shown in FIG. 3.

Embodiment (2)

In this embodiment the carrier is also the $Al_2O_3$ ceramic particles and proceed the steps (1)~(3) as described in the embodiment (1). And then proceed the electroless plating process of the step (4), wherein the electroless plating bath and operation condition are shown in table (2) below.

TABLE 2

The electroless plating bath and the operation parameters

| Ingredient or parameter | Chemical formula | Concentration or Value |
|---|---|---|
| Nickel sulfate | $NiSO_4 \cdot 7H_2O$ | 40 (g/L) |
| Ammonium ferrous sulfate | $(NH_4)_2Fe(SO_4)$ | 50 (g/L) |
| Sodium hypophosphate | $NaH_2PO_2$, $H_2O$ | 25 (g/L) |
| Ammonium hydroxide | $NH_4OH$ | 60 (g/L) |
| Potassium sodium tartarate | $KNaC_4H_4O_6$ | 80 (g/L) |
| pH | | 9.5 |
| Temperature | | 30° C. |

Then proceed the step (5) of embodiment (1) to get the $Al_2O_3$ particles containing Fe—Ni nano-particles, which is almost the same as the FIGS. 1, 2, and 3 shown.

Embodiment (3)

The embodiment (3) of the present invention selects the $SiO_2$ ceramic particles as the carrier and proceed the steps (1)~(3) as described in the embodiment (1). And then proceed the electroless plating process of the step (4), wherein the electroless plating bath and operation condition are shown in table (3) below.

TABLE 3

The electroless plating bath and the operation condition

| Ingredient or parameter | Chemical formula | Concentration or Value |
|---|---|---|
| Nickel chloride | $NiCl_2 \cdot 6H_2O$ | 50 (g/L) |
| Ferrous chloride | $FeCl_2 \cdot 4H_2O$ | 50 (g/L) |
| Sodium hypophosphate | $NaH_2PO_2 \cdot H_2O$ | 25 (g/L) |
| Ammonium hydroxide | $NH_4OH$ | 60 (g/L) |
| Potassium sodium tartarate | $KNaC_4H_4O_6$ | 10 (g/L) |
| pH | | 10 |
| Temperature | | 75° C. |

Then proceed the step (5) of embodiment (1) to get the powder containing Fe—Ni nano-particles, which is almost the same as the embodiment (1).

Embodiment (4)

The embodiment (4) of the present invention as the embodiment (3) selects the $SiO_2$ ceramic particles as the carrier and proceed the steps (1)~(3) as described in the embodiment (1). And then proceed the electroless plating process of the step (4), wherein the electroless plating bath and operation condition are shown in table (4) below.

TABLE 4

The electroless plating bath and the operation parameters

| Ingredient or parameter | Chemical formula | Concentration or Value |
|---|---|---|
| Nickel acetate | $Ni(Ac)_2$ | 30 (g/L) |
| Ferrous sulfate | $FeSO_4 \cdot 7H_2O$ | 15 (g/L) |
| Sodium hypophosphate | $NaH_2PO_2 \cdot H_2O$ | 10 (g/L) |
| urea | $CO(NH_2)_2$ | 40 (g/L) |
| Potassium sodium tartarate | $KNaC_4H_4O_6$ | 40 (g/L) |
| pH | | 9 |
| Temperature | | 90° C. |

Then proceed the step (5) of embodiment (1) to get the powder containing Fe—Ni nano-particles, which is almost the same as the embodiment (1).

Embodiment (5)

The embodiment (5) of the present invention selects the $TiO_2$ ceramic particles as the carrier and proceed the steps (1)~(3) as described in the embodiment (1). And then proceed the electroless plating process of the step (4), wherein the electroless plating bath and operation condition are shown in table (5) below.

TABLE 5

The electroless plating bath and the operation parameters

| Ingredient or parameter | Chemical formula | Concentration or Value |
|---|---|---|
| Nickel sulfate | $NiSO_4 \cdot 7H_2O$ | 15 (g/L) |
| Ferrous sulfate | $FeSO_4 \cdot 7H_2O$ | 15 (g/L) |
| Boric acid | $H_3BO_3$ | 30 (g/L) |
| Sodium hypophosphate | $NaH_2PO_2 \cdot H_2O$ | 20 (g/L) |
| Sodium citrate | $Na_3C_6H_5O_7$ | 60 (g/L) |
| pH | | 10 |
| Temperature | | 90° C. |

Then proceed the step (5) of embodiment (1) to get the powder containing Fe—Ni nano-particles, which is almost the same as the embodiment (1).

The above statement is only the preferred embodiments of the present invention, they cannot be used to limit the scope of the present invention. The all apparent modification and application made by the persons who are skilled at this field should be regard as the content of the present invention.

The powder containing Fe—Ni nano-particle and its manufacturing method has the following advantages:

(1) Because the Fe—Ni nano-particles with only nanometers size have very small volume and very large surface area, the contact chance between Fe/Ni bimetal and chlorinated organic substance is largely increased and the effect of processing chlorinated pollutants is consequently promoted.

(2) The Fe and Ni atoms on the Fe—Ni nano-particles are simultaneously reduced from the electroless plating solution containing $Fe^{++}$ and $Ni^{++}$ ions. They can simultaneously exist on the surface of the Fe—Ni nano-particles and can simultaneously contact with the chlorinate substance to proceed catalytic reaction, so the effect of processing chlorinated pollutants is consequently promoted.

(3) The Fe—Ni nano-particles are produced by the simultaneous reduction of the $Fe^{++}$ and $Ni^{++}$ ions from the electroless plating solution. The atomic ratio of the Fe and Ni atoms in the Fe—Ni nano-particles can be controlled by changing the relative concentration of the $Fe^{++}$ and $Ni^{++}$ ions in the plating solution and the plating condition, i.e. the atomic ratio of the Fe and Ni atoms on the surface of the nanoparticle can be changed to suit for various chlorinated; pollutant treatments.

(4) The Fe—Ni nano-particles are deposited on the surface of the ceramic particles by the simultaneous reduction of the $Fe^{++}$ and $Ni^{++}$ ions from the electroless plating solution. The size of these ceramic carriers is about micrometer (μm), it just suits for penetrating the soil containing pollutants and does not quickly flow away. Additionally, the ceramic particles such as $Al_2O_3$, $SiO_2$, $TiO_2$, CaO, SiC and WC are so stable in chemistry that they suit to act as the carrier and do not produce secondary contamination.

(5) The powder containing Fe—Ni nano-particles according the present invention are manufactured by the electroless plating technique. This manufacturing method is conducted in the aqueous solution at low temperature, so the consumed energy can be saved and the powder can be mass-produced. In addition, the method is simple so that it does not need expensive and complex equipments. Therefore, the power containing Fe—Ni nano-particles provided by the present invention cost low and can be mass-produced to provide for the treatment and remediation of polluted soil of large area.

To sum up, the present invention indeed can accomplish its expected object to provide a powder containing Fe—Ni nano-particles and its manufacturing method. The powder can be used to treat the chlorinated pollutants in the environment. It has its industrial practical value.

Having thus described my invention, what I claim as new and desire to be secured by Letters Patent of the United States are:

1. A powder containing Fe—Ni nano-particles, comprising a ceramic particle and Fe—Ni nano-particles, wherein the average size of said ceramic particle is micrometer (μm)-sized and said Fe and Ni atoms of said Fe—Ni nano-particles are deposited on the surface of said ceramic particle by an electroless plating technique.

2. The powder containing Fe—Ni nano-particles as claimed in claim 1 wherein said ceramic particle is selected from a group consisting of Al2O3, SiO2, TiO2, CaO, SiC, and WC.

* * * * *